US005312287A

United States Patent [19]

Chuang

[11] Patent Number: 5,312,287

[45] Date of Patent: May 17, 1994

[54] TOY WITH ELECTROMAGNET SIMULATING INJURY

[76] Inventor: Gary Chuang, 19, Alley 46, Lane 1, Tung An Street, Ho Mei Shen, Changhua, Taiwan

[21] Appl. No.: 961,843

[22] Filed: Oct. 16, 1992

[51] Int. Cl.[5] ..... A63H 3/00; A63H 33/26; A63H 3/28; A63H 3/02

[52] U.S. Cl. ..... 446/295; 446/139; 446/300; 446/372

[58] Field of Search ..... 446/129, 130, 137, 138, 446/139, 268, 295, 296, 297, 298, 300, 302, 303, 369, 370, 372, 390, 472, 484

[56] References Cited

U.S. PATENT DOCUMENTS

| | | | |
|---|---|---|---|
| 2,242,442 | 5/1941 | Smith | 446/302 X |
| 2,250,916 | 7/1941 | Magruder | 446/302 X |
| 2,781,611 | 2/1957 | Bills et al. | 446/295 X |
| 2,959,891 | 11/1960 | Barnett et al. | 446/295 |
| 3,184,886 | 5/1965 | Weih | 446/295 |
| 4,075,782 | 2/1978 | Neuschatz | 446/295 |
| 4,696,652 | 9/1987 | McKeefery | 446/303 X |
| 4,820,233 | 4/1989 | Weiner | 446/303 |
| 4,917,647 | 4/1990 | Wetherell et al. | 446/268 X |

FOREIGN PATENT DOCUMENTS

| | | | |
|---|---|---|---|
| 2191916 | 12/1987 | United Kingdom | 446/297 |
| 2196545 | 5/1988 | United Kingdom | 446/297 |

*Primary Examiner*—David N. Muir
*Attorney, Agent, or Firm*—Bacon & Thomas

[57] ABSTRACT

A simulation toy includes an electromagnet received in a slot on the body of the toy and attached with a permanent magnet mounted flush with the toy, a control circuit controlled by a snap switch reciprocates a reciprocating rod through the electromagnet in pushing the permanent magnet out of the slot for showing a red colored area simulating a wound and simultaneously activate a speaker for making a sound simulating the crying of a child.

2 Claims, 3 Drawing Sheets

TOY WITH ELECTROMAGNET SIMULATING INJURY

BACKGROUND OF THE INVENTION

1. Field of the Invention

The present invention relates to a simulation toy which shows a red colored area simulating a wound and makes a sound simulating the crying of a child who has fallen.

2. Description of Prior Art

Various audible sound producing toys are known and widely accepted by children of all ages. These audible sound producing toys commonly use a sound reproducing device to reproduce a pre-recorded sound in simulating the crying or laughing of a child. One disadvantage of these audible sound producing toys is that the sound reproducing device requires a large installation space. Another disadvantage of these audible sound producing toys is that the sound reproducing device is triggered to make a sound only when the head of the respective toy is hit by force. It is not suitable to teach a child how to hit a toy to make it cry.

SUMMARY OF THE INVENTION

The present invention provides a simulation toy which shows a red colored area simulating a wound and makes a sound simulating the crying of a child falling from a higher place, so as to teach a child not to climb a tree or a dangerous high place.

According to the preferred embodiment, a simulation toy has a slot at a suitable location, an electromagnet inserted in the slot and having a red colored iron plate attached with a permanent magnet flush mounted with the outside surface of the toy, and a control circuit to control the operation of the electromagnet and a speaker. The control circuit has an input terminal connected to a power supply by a snap switch, a first output terminal connected to a coil of the electromagnet through a first transistor, and a second output terminal connected to a speaker through a second transistor. The snap switch is triggered when the toy falls from a higher place, thus causing the control circuit to drive the core of the electromagnet in pushing the permanent magnet away from the toy and simultaneously activating the speaker to make a sound simulating the crying of a child.

BRIEF DESCRIPTION OF THE DRAWINGS

The foregoing and other objects, features and advantages of the present invention will be best understood from the following description, the appended claims and accompanying drawings in which:

DETAILED DESCRIPTION OF THE PREFERRED EMBODIMENT

Figure 1:
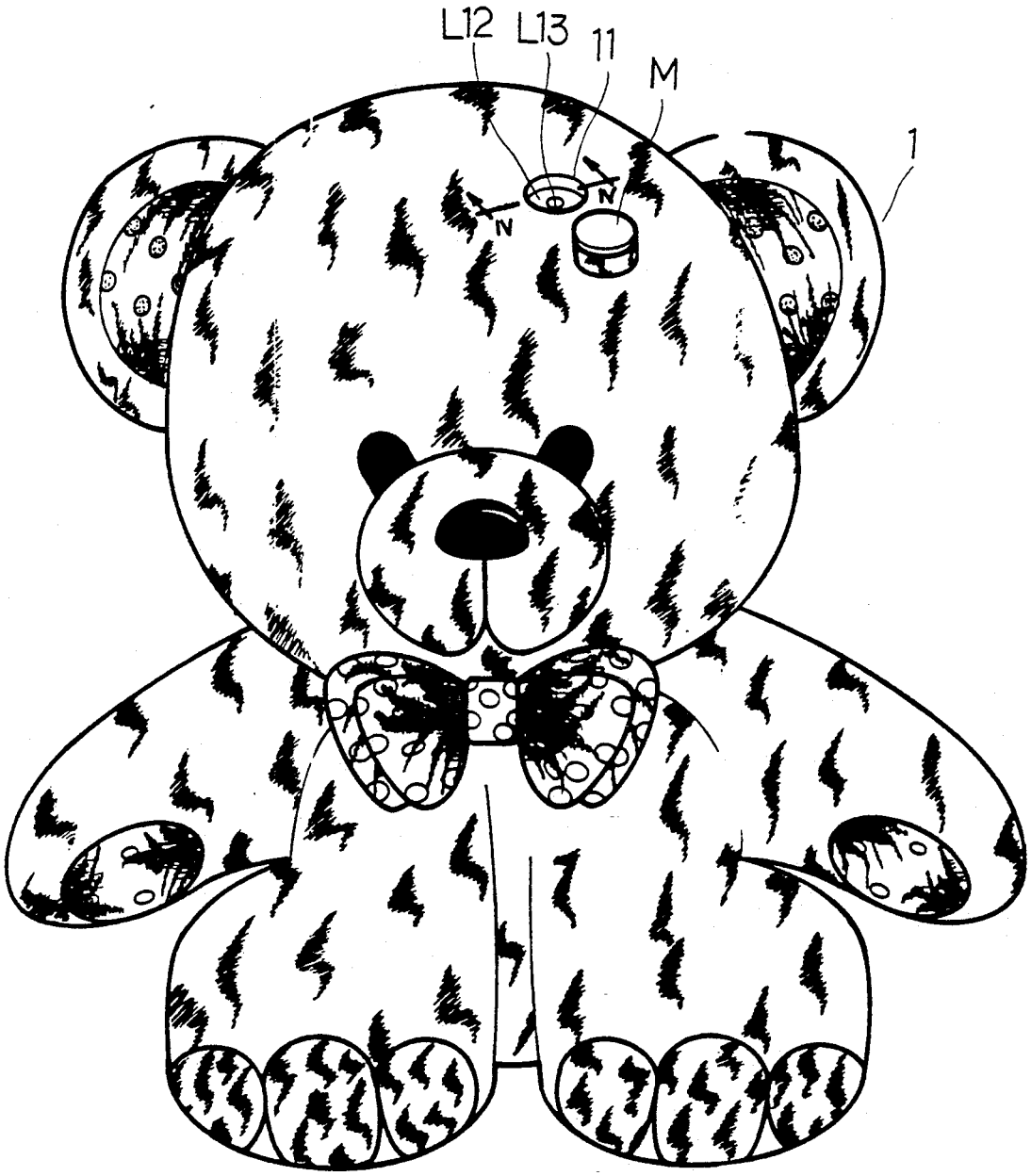
FIG. 1 shows the structure of an electromagnet and its position on a toy according to the present invention.
Figure 3:
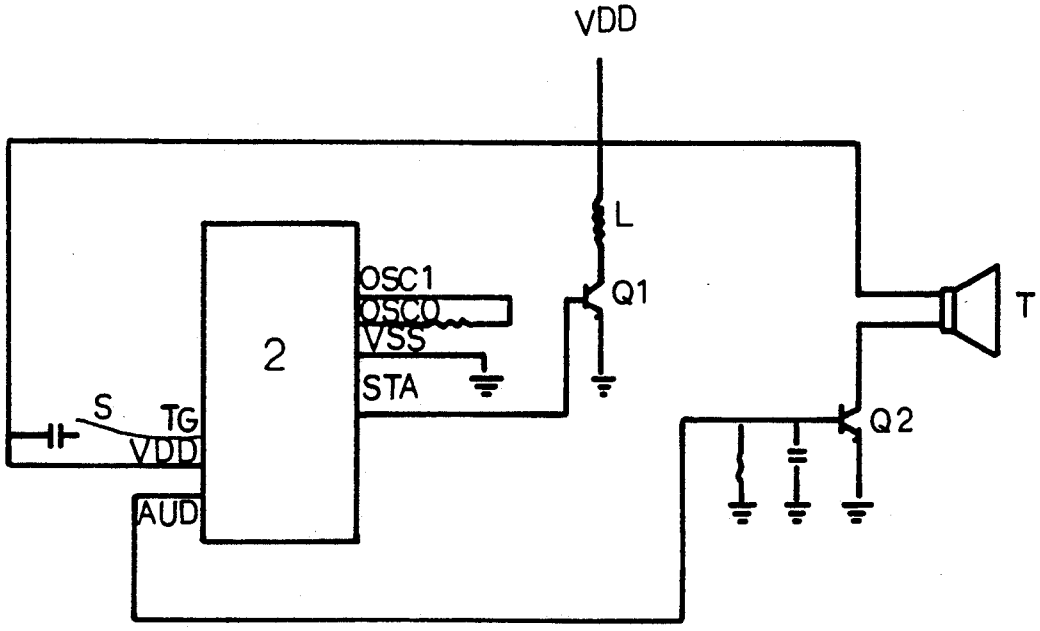
FIG. 3 is a circuit diagram of the control circuit.
Figure 4:
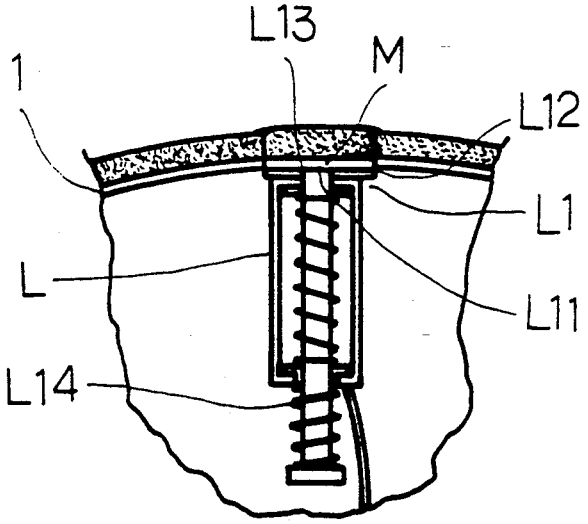
FIG. 4 is a partial cross-sectional view taken along line IV—IV in FIG. 1.

Referring to FIGS. 1 and 3, a toy which may be variously shaped and is referenced by 1, has a slot 11 at a suitable location, which receives an electromagnet L. The electromagnet L has an iron plate L12 at one end L1 attached with a permanent magnet M mounted flush with the outside surface of the toy 1, and a reciprocating rod L11 inserted in a longitudinal hole (not shown) therein and having a tip coupled with a rubber cushion L13 controlled to move the permanent magnet M out of the toy 1 for permitting the iron plate L12 which is colored in red to be exposed to the outside. The coil of the electromagnet L is connected to a first output terminal STA of a control circuit 2 through a first transistor Q1. The control circuit 2 has a second output terminal AUD connected to a speaker T through a second transistor Q2 and controlled to make a sound simulating the crying of a child.

Figure 2:
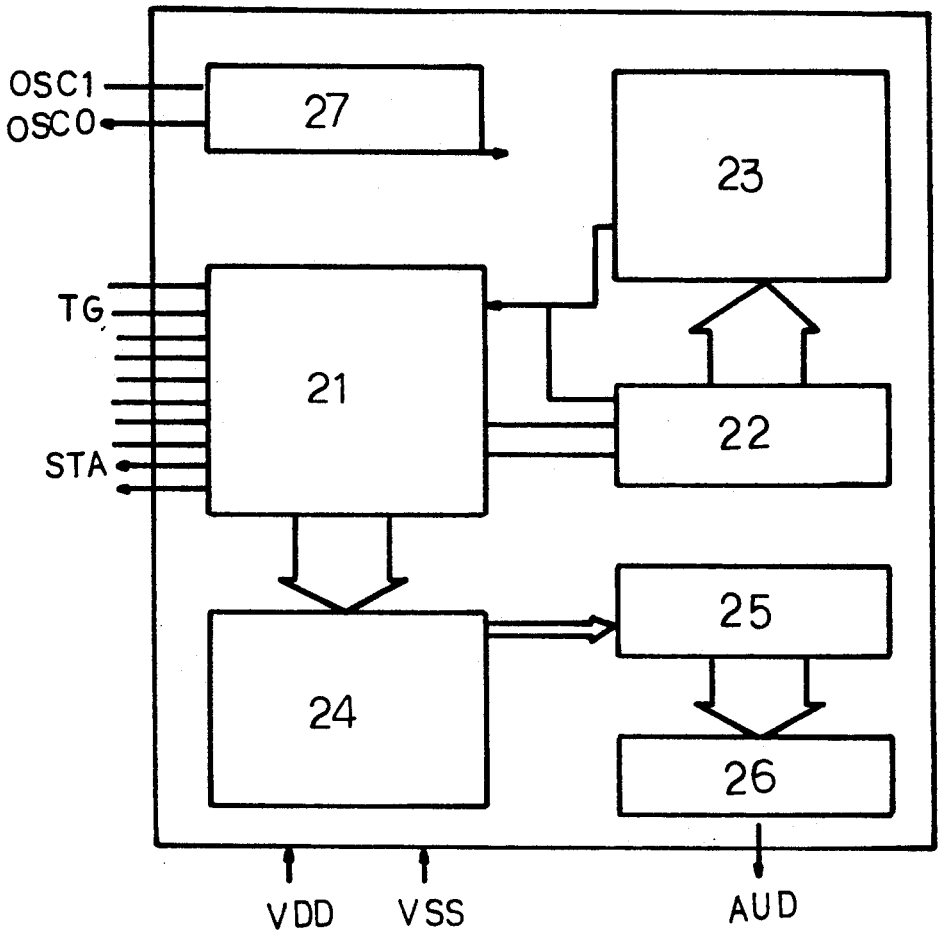
FIG. 2 is a systematic circuit block diagram of a control circuit according to the present invention.

Referring to FIG. 2 and FIG. 3 again, the control circuit 2 has an input terminal TG connected to power supply VDD through a snap switch S. As the snap switch S was connected, a process controller 21 is triggered to produce a shift pulse for driving a count and shift register 22 so as to obtain from it a prestored speech signal and the number of times in repeating the signal. The output signal from the speech processor 23 is sent to an encoder 24 causing it to provide a shift pulse for driving a shift register 25. Once the shift register 25 is triggered, it provides an output through a digital analog converter 26, namely, the second output terminal AUD, to turn on the second transistor Q2, and therefore the speaker T is driven to make a sound or sounds corresponding to the pre-stored speech signal. The operational sequence is controlled by a clock 27, and therefore erroneous action is eliminated.

Therefore, the snap switch S will be triggered to turn on the electromagnet L as the toy 1 falls from a higher place, causing the permanent magnet M to be moved away from the toy 1 by the reciprocating rod L1, and therefore the red colored iron plate L12 on the end L1 of the electromagnet L will be exposed to the outside to simulate a wound. Once the permanent magnet M is moved away from the toy 1, the snap switch S becomes disconnected, and the reciprocating rod L11 is immediately moved back to its former position by a return spring L14. As the same time, the signal from the snap switch S triggers the control circuit 2 to produce a sound or sounds simulating the crying of a child.

What is claimed is:

1. A simulation toy comprising:

a) a toy having an outside surface and a slot formed therein;

b) an electromagnet disposed within the slot, the electromagnet including a red-colored iron plate, a permanent magnet attached to the iron plate a reciprocating rod, a rubber cushion covering the reciprocating rod, a wire coil for reciprocating the reciprocating rod to push the permanent magnet away from the toy;

c) a control circuit including a first transistor, a first output terminal connected to the wire coil through the first transistor, a second transistor, a speaker, a second output terminal connected to the speaker through the second transistor, a snap switch, a power supply, and an input terminal connected to the power supply through the snap switch; and d) wherein the snap switch is triggered when the toy is struck or falls, thereby causing the control circuit to drive the reciprocating rod in pushing the permanent magnet away from the toy and simultaneously activating the speaker to make a sound.

2. The simulation toy of claim 1 wherein said control circuit comprises a process controller controlled by said snap switch to produce a shift pulse in driving a count and shift register to obtain a prestored speech signal and the number of times in repeating the speech signal from a speech processor, causing said speech processor to give an output signal to an encoder for driving a digital analog converter via a shift register, permitting said digital analog converter to produce an audio output signal for output through said speaker via said second transistor, the operational sequence of said control circuit being controlled by a clock generator.

* * * * *